US005238414A

United States Patent [19]

Yaegashi et al.

[11] Patent Number: 5,238,414

[45] Date of Patent: Aug. 24, 1993

[54] HIGH-SPEED TRANSMISSION ELECTRICAL CONNECTOR

[75] Inventors: Hirokatsu Yaegashi; Tadahiro Fumikura, both of Tokyo, Japan

[73] Assignee: Hirose Electric Co., Ltd., Tokyo, Japan

[21] Appl. No.: 897,055

[22] Filed: Jun. 11, 1992

[30] Foreign Application Priority Data

Jul. 24, 1991 [JP] Japan ..... 3-206193

[51] Int. Cl.[5] ..... H01R 13/648; H01R 13/652

[52] U.S. Cl. ..... 439/108; 439/608

[58] Field of Search ..... 439/101, 108, 608, 609

[56] References Cited

U.S. PATENT DOCUMENTS 4,655,518 4/1987 Johnson et al. ..... 439/108
4,846,727 7/1989 Glover et al. ..... 439/108
4,975,084 12/1990 Fedder et al. ..... 439/108
5,046,960 9/1991 Fedder ..... 439/108
5,116,230 5/1992 Dechelette et al. ..... 439/101

*Primary Examiner*—Gary F. Paumen
*Attorney, Agent, or Firm*—Kanesaka & Takeuchi

[57] ABSTRACT

A high-speed transmission electrical connector assembly consists of the first and second connectors. The first connector includes a first housing (1); a plurality of first contact elements (12) arranged in rows and columns in the first housing; and a plurality of first shield terminals (14) each disposed between a pair of first contact elements and aligned in rows. The second connector includes a second housing (2); a plurality of second contact elements (24) arranged in rows and columns in the second housing; and a plurality of second shield terminals (25) each disposed between a pair of second contact elements and aligned in columns 4 Claims, 6 Drawing Sheets

HIGH-SPEED TRANSMISSION ELECTRICAL CONNECTOR

BACKGROUND OF THE INVENTION

1. Field of the Invention

The present invention relates to high-speed transmission electrical connectors for connecting daughter cards to mother boards.

2. Description of the Prior Art

In computers and communications technologies, the speed of signal transmission, the frequency of transmitted signals, and the density of components mounted on substrate are been increased. Consequently, high-speed transmission connectors for connecting such substrate to units have a great number of terminal contacts.

In such connectors, it is necessary to shield the contact elements. U.S. Pat. No. 4,655,518 discloses a connector which includes a pair of ground plates provided between mating housings each having rows and columns of contact elements thereon. Each ground plate has an extended contact portion which is brought into contact with a board when the connector is attached to the board.

However, the above connector failed to provide a characteristic impedance match for the transmission line because (1) the distance between the contact elements and the ground plate is different for each contact element, (2) the ground plates have few effects on the contact elements in locations opposite to the ground plate, and (3) there are no shields between the contact elements, thus disturbing the signal waveforms.

SUMMARY OF THE INVENTION

Accordingly, it is an object of the invention to provide a high-speed transmission electrical connector which is able to be mounted with high density.

It is another object of the invention to provide a high-speed transmission electrical connector in which the respective contact elements are uniformly shielded.

According to the invention there is provided a high-speed transmission electrical connector assembly which consists of the first and second connectors. The first connector includes a first housing; a plurality of first contact elements arranged in rows and columns in the first housing; and a plurality of first shield terminals each disposed between a pair of first contact elements and aligned in rows. The second connector includes a second housing; a plurality of second contact elements arranged in rows and columns in the second housing; and a plurality of second shield terminals each disposed between a pair of second contact elements and aligned in columns.

When both of the housings are fitted together, the respective contact elements and shield terminals are brought into contact with the corresponding contact elements and shield terminals. The shield terminals of one of the housings are aligned in row while those of the other housing are in column so that when fitted together, they surround each contact element completely. In addition, the surrounding shield terminals are very close to the contact elements and equidistance from the respective contact elements. The end portions of the shield terminals projected from the housing are grounded to a board so that the contact elements are shielded completely, and a characteristic impedance match is provided.

The above and other objects, features, and advantages of the invention will be more apparent from the following description when taken in conjunction with the accompanying drawings.

DESCRIPTION OF THE PREFERRED EMBODIMENT

Figure 1:
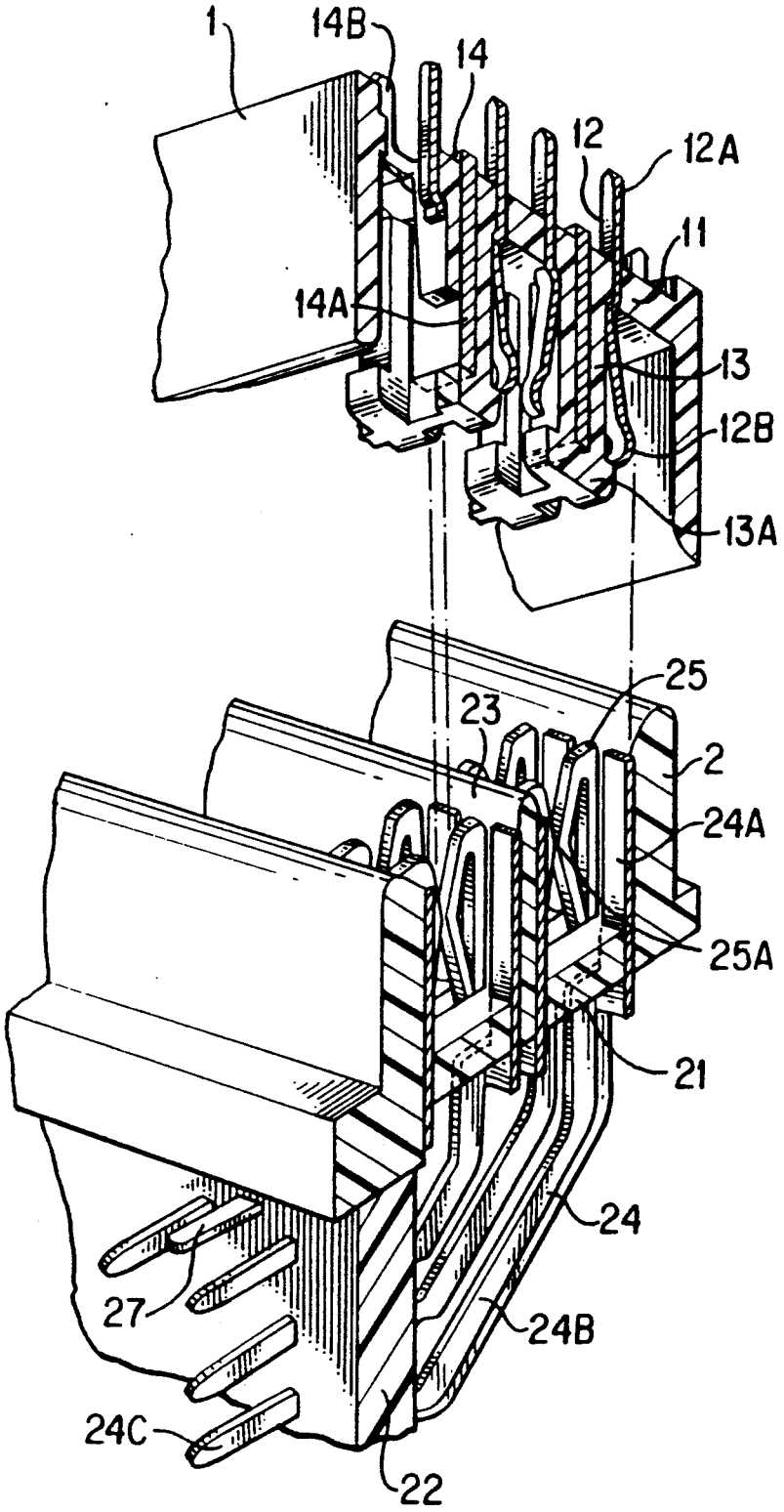
FIG. 1 is a partially sectional perspective view of a pair of electrical connectors before connection according to an embodiment of the invention.

In FIG. 1, a number of contact elements 12 are arranged in rows and columns on the ceiling 11 of a housing 1 such that the connection portions 12A project upwardly from the ceiling 11 for connection to a substrate or mother board. In the figure, contact elements are shown in a column and four rows. The contact elements 12 are arranged within the housing 1 such that the curved contact portions 12B are aligned in the same direction in every other row. Each contact element 12 has a diagonal portion between the connection portion 12A and the contact portion 12B to provide a spring property to the contact portion 12B.

The housing 1 has a partition wall 13 between each pair of rows of contact elements 12. Each partition wall 13 has a projection 13A for each column and a window between each pair of projections 13A.

Figure 2:
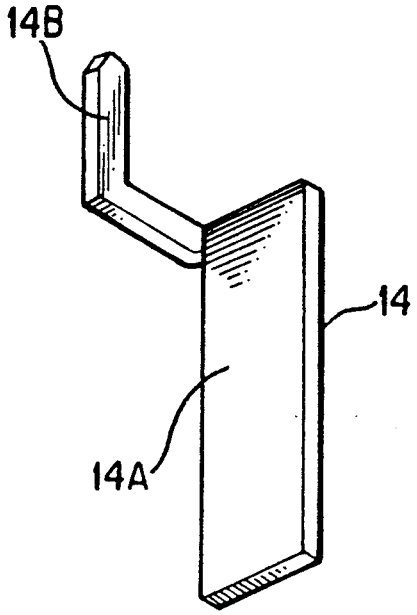
FIG. 2 is a shield terminal of one of the electrical connectors.

As shown in FIG. 2, the shield terminal 14 has a flat portion 14A and an L-shaped connection portion 14B extending laterally and then upwardly from the flat portion 14A. The width of the flat portion 14A is made substantially equal to the distance between adjacent projections 13A. Shield terminals 14 are inserted into slots of the partition wall 13 such that the flat portion 14A are exposed through the windows.

Figure 3:
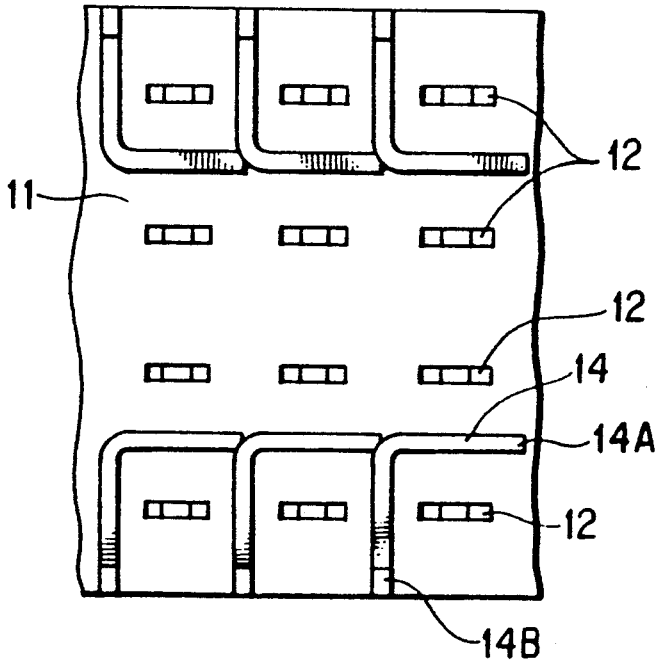
FIG. 3 is a top plan view of the electrical connector.

FIG. 3 shows how the contact elements 12 and the shield terminals 14 are arranged in the housing 1.

Referring back to FIG. 1, the other connector housing 2 has a base 21 and a mount 22 extending downwardly from the base 21. A partition wall 23 is formed so as to be inserted into a space between the partition walls 13 of the housing 1. Four rows of contact elements 24 are mounted on the base 21 such that the flat contact elements 24A are brought into contact with the contact elements 12 of the housing 1.

Figure 4:
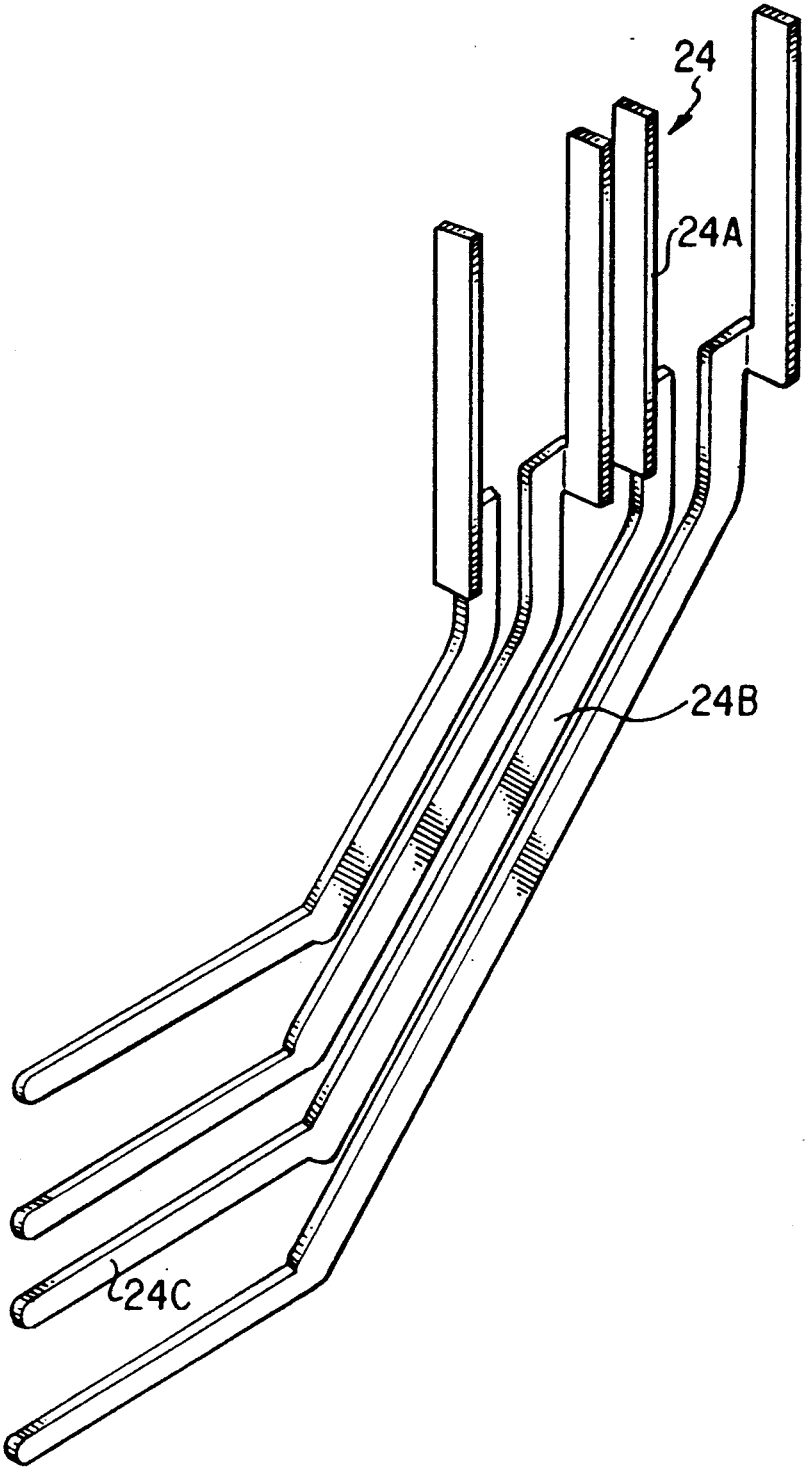
FIG. 4 is a perspective view of contact elements of the other electrical connector.

In FIG. 4, the contact elements 24 have a diagonal section 24B between the contact portion 24A and the connection portion 24C. The diagonal sections 24B are different in length so that the contact portions 24A and the connection portions 24C are aligned in columns. The contact portions 24A have a plane parallel to the row while the diagonal sections 24B and the connection portions 24C have a plane parallel to the column. The contact elements 24 are mounted into the housing 2 by either inserting the contact portions 24A into the housing through the base 21 and then the connection portions 24C into the mount 22 or inserting the connection portions 24C into the mount 22 and then the contact portions 24A into the housing through the base 21.

Figure 5:
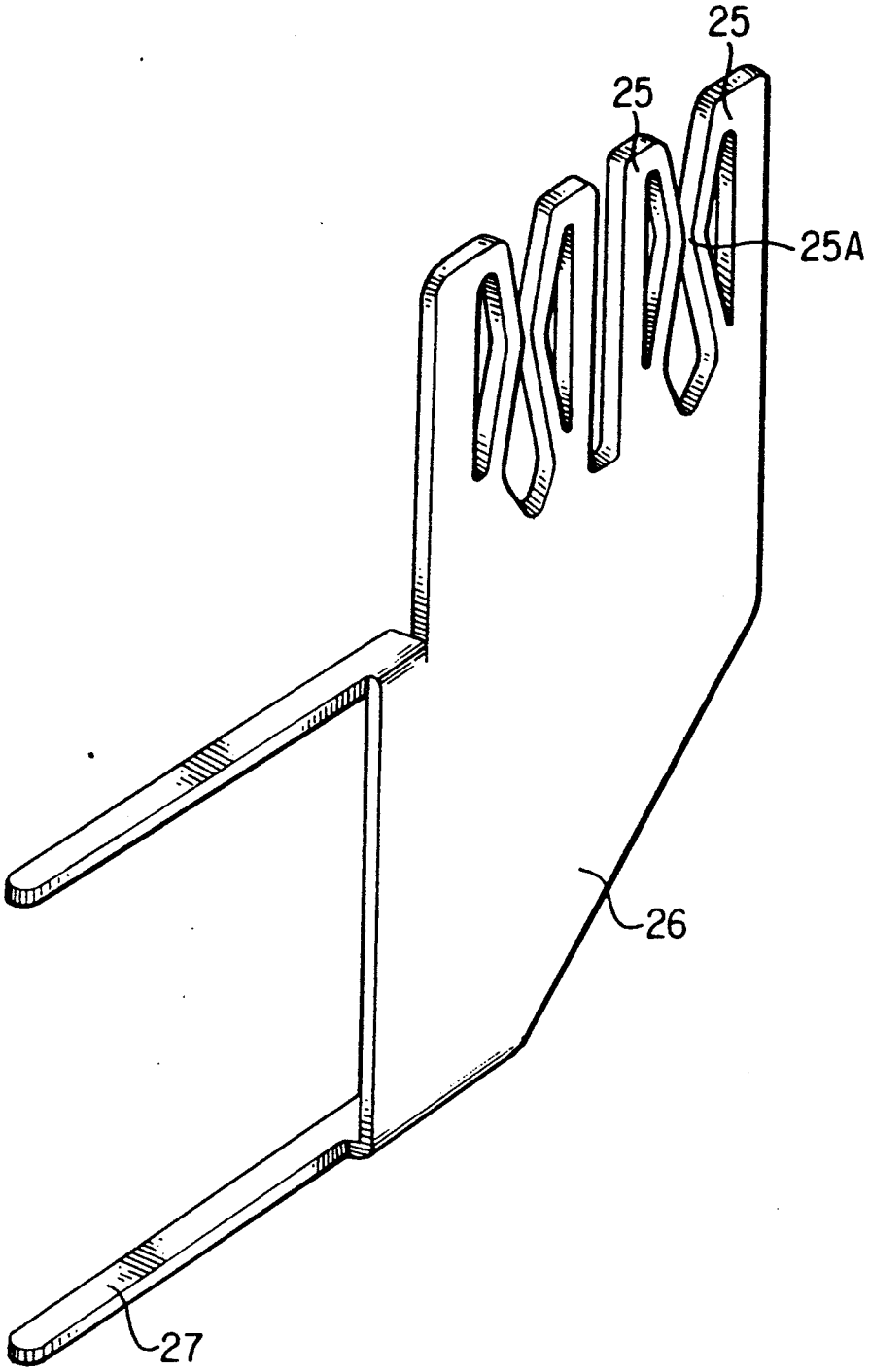
FIG. 5 is a perspective view of a shield terminal of the other electrical connector.

In FIG. 5, two pairs of shield terminals 25, which are mounted between adjacent contact elements 24, extend upwardly from a common shield plate 26 such that each pair of shield terminals forms a narrow passage 25A to provide a spring property to the terminals. The width of the narrow passage 25A is set slightly smaller than the thickness of the flat portion 14A of the shield terminal 14. A pair of connection legs 27 extend outwardly from the side edge of the shield plate 26. These shield terminals 25 are mounted in the housing 2 by either inserting the shield terminals 25 through the base 21 and then the connection legs 27 through the mount 22 or inserting the connection legs 27 into the mount 22 and then the shield terminals 25 through the base 21.

Figure 6:
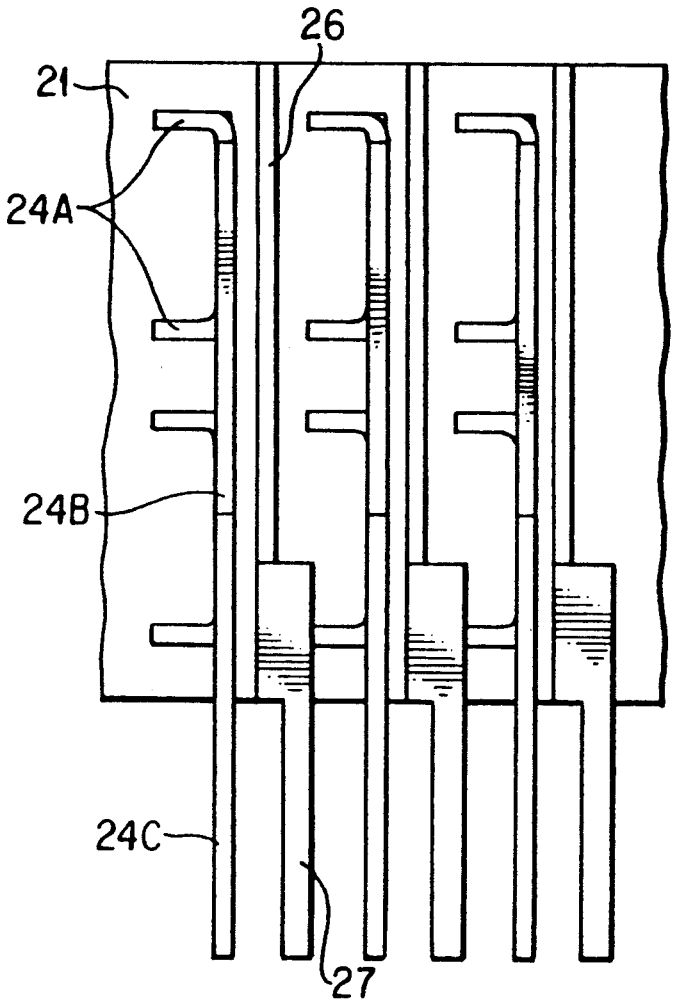
FIG. 6 is a bottom plan view of the other electrical connector.

FIG. 6 shows how the contact elements 24 and the shield terminals 25 are arranged in the housing 2.

Figure 7:
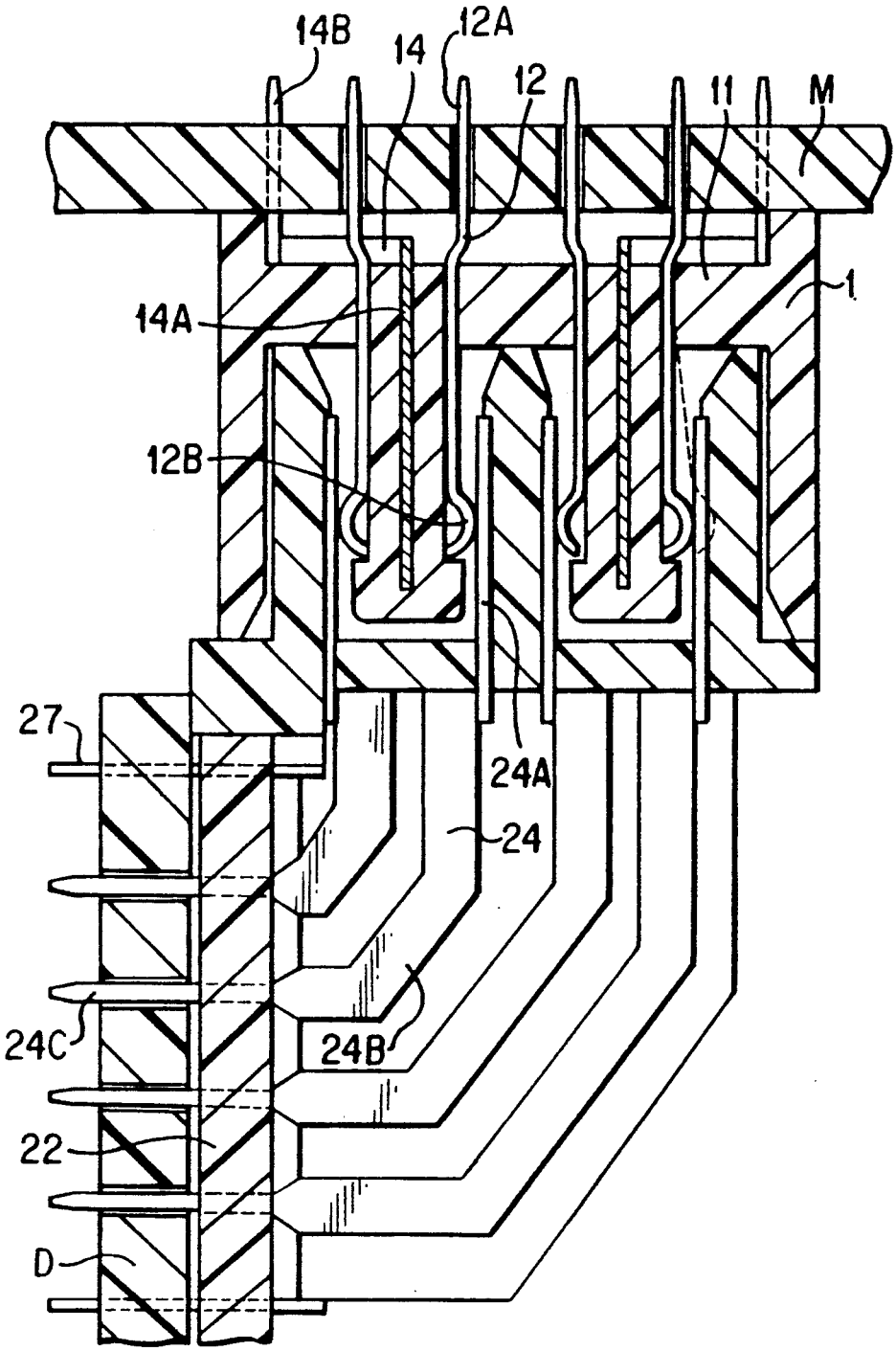
FIG. 7 is a sectional view of the electrical connectors connected.

In FIG. 7, the connector 2 mounted on a daughter card D is fitted into the connector 1 mounted on a mother board M such that the contact portions 12B of the contact elements 12 of the connector 1 are brought into spring contact with the contact portions 24A of the contact elements 24 of the connector 2 for making an electrical connection. The flat portions 14A of the shield terminals 14, which are exposed through the windows of the partition walls, are brought into spring contact with the narrow passages 25A of the shield terminals 25 for making a shield connection. Since the flat portion 14A of the shield terminals 14 are perpendicular to the shield terminals 25, the respective contact elements 12 are surrounded closely and equidistantly by the shield walls having an L cross section, thereby providing an efficient and uniform shielding effect.

As has been described above, the connector according to the invention has a simple structure yet is able to provide an efficient and uniform shielding effect on the respective contact elements and a characteristic impedance match for the transmission line, thereby preventing disturbances to the signal waves.

We claim:

1. A high-speed transmission electrical connector assembly consisting of first and second connections, said first connector comprising:

a first housing having a plurality of partition walls extending along rows each having a plurality of windows;

a plurality of first contact elements arranged in rows and columns on opposite sides of each partition wall in said first housing; and a plurality of first shield terminals each disposed between a pair of first contact elements and having a flat portion lying in a first plane of a respective row, said second connector comprising:

a second housing;

a plurality of second contact elements arranged in rows and columns in said second housing; and a plurality of second shield terminals each disposed between a pair of second contact elements and lying in a second plane of a respective column which is normal to said first plane so that when said two connectors are mated, each of said contact elements are individually surrounded by said shield terminals on four sides in both directions of rows and columns.

2. The high-speed transmission electrical connector assembly of claim 1, wherein each of said second shield terminals, has a plurality of pairs of shield terminals each pair forming a narrow passage to provide a spring property so that when said two connectors are mated, said second shield terminals are brought into spring contact with said first flat shield terminals through said windows.

3. The high-speed transmission electrical connector assembly of claim 2, wherein said narrow passage has a width slightly smaller than the thickness of said first flat shield terminals.

4. A high-speed transmission electrical connector comprising:

an insulating housing have a plurality of discrete partition walls extending in rows;

a plurality of contact elements arranged in rows and columns on opposite sides of each partition wall in said housing; and a plurality of shield terminals each disposed in one of said partition walls and extending along and equidistant from a pair of said contact elements thereby providing a characteristic impedance match.

* * * * *